US006641714B2

(12) United States Patent
Walsh

(10) Patent No.: US 6,641,714 B2
(45) Date of Patent: Nov. 4, 2003

(54) HYDROCARBON UPGRADING PROCESS

(75) Inventor: Dennis E. Walsh, Richboro, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 95 days.

(21) Appl. No.: 09/900,069

(22) Filed: Jul. 6, 2001

(65) Prior Publication Data

US 2002/0038776 A1 Apr. 4, 2002

Related U.S. Application Data

(60) Provisional application No. 60/219,934, filed on Jul. 21, 2000.

(51) Int. Cl.[7] ..... C10G 69/02

(52) U.S. Cl. ..... 208/58; 208/89; 208/212; 208/213

(58) Field of Search ..... 208/58, 89, 212, 208/213

(56) References Cited

U.S. PATENT DOCUMENTS

| | | | | | |
|---|---|---|---|---|---|
| 4,439,409 | A | | 3/1984 | Puppe et al. | 423/328 |
| 4,826,667 | A | | 5/1989 | Zones et al. | 423/277 |
| 4,954,325 | A | | 9/1990 | Rubin et al. | 423/328 |
| 5,236,575 | A | | 8/1993 | Bennett et al. | 208/46 |
| 5,250,277 | A | | 10/1993 | Kresge et al. | 423/329.1 |
| 5,298,150 | A | * | 3/1994 | Fletcher et al. | 208/89 |
| 5,308,471 | A | * | 5/1994 | Apelian et al. | 208/89 |
| 5,320,742 | A | * | 6/1994 | Fletcher et al. | 208/89 |
| 5,346,609 | A | | 9/1994 | Fletcher et al. | 208/89 |
| 5,352,354 | A | | 10/1994 | Fletcher et al. | 208/89 |
| 5,360,532 | A | | 11/1994 | Fletcher et al. | 208/89 |
| 5,362,697 | A | | 11/1994 | Fung et al. | 502/71 |
| 5,391,288 | A | * | 2/1995 | Collins et al. | 208/89 |
| 5,397,455 | A | * | 3/1995 | Timken | 208/60 |
| 5,409,596 | A | | 4/1995 | Fletcher et al. | 208/89 |
| 5,411,658 | A | | 5/1995 | Chawla et al. | 208/89 |
| 5,413,697 | A | | 5/1995 | Fletcher et al. | 208/89 |
| 5,486,284 | A | | 1/1996 | Degnan et al. | 208/120 |
| 5,500,108 | A | | 3/1996 | Durand et al. | 208/89 |
| 5,503,734 | A | | 4/1996 | Fletcher et al. | 208/89 |
| 5,510,016 | A | | 4/1996 | Hilbert et al. | 208/89 |
| 5,536,894 | A | | 7/1996 | Degnan et al. | 585/467 |
| 5,599,439 | A | | 2/1997 | Collins et al. | 208/89 |
| 5,643,441 | A | | 7/1997 | Timken et al. | 208/89 |
| 5,685,972 | A | | 11/1997 | Timken et al. | 208/89 |
| 5,840,988 | A | | 11/1998 | Eller et al. | 564/485 |

* cited by examiner

*Primary Examiner*—Walter D. Griffin
(74) *Attorney, Agent, or Firm*—Gerard J. Hughes; Jeremy J. Kliebert

(57) ABSTRACT

Low sulfur gasoline of relatively high octane number is produced from a catalytically or thermally cracked, olefin-rich, sulfur-containing hydrocarbon stream by hydrodesulfurization followed by treatment over an acidic catalyst containing a molecular sieve belonging to the MCM-22 family in combination with a metal component, preferably selected from the transition elements of the $4^{th}$ and $5^{th}$ periods of the Periodic Table. The treatment over the acidic catalyst in the second step restores the octane loss which takes place as a result of the hydrogenative treatment and results in a low sulfur gasoline product with an octane number comparable to that of the hydrocarbon feed.

12 Claims, 6 Drawing Sheets

HYDROCARBON UPGRADING PROCESS

CROSS REFERENCE TO RELATED APPLICATION

This case claims benefit of U.S. Provisional Patent Application No. 60/219,934 filed Jul. 21, 2000.

FIELD OF THE INVENTION

This invention relates to a process for the upgrading of hydrocarbon streams. It more particularly refers to a process for upgrading gasoline boiling range petroleum fractions containing substantial proportions of sulfur impurities. The process involves integration of a first stage hydrotreating of a sulfur-containing cracked petroleum fraction in the gasoline boiling range and a second stage conversion of the hydrotreated intermediate product over a catalyst comprising a molecular sieve.

BACKGROUND OF THE INVENTION

Catalytically cracked gasoline forms a major part of the gasoline product pool in the United States. It is conventional to recover the product of catalytic cracking and to fractionate the product into various fractions such as light gases; naphtha, including light and heavy gasoline; distillate fractions, such as heating oil and diesel fuel; lube oil base fractions; and heavier fractions. A secondary source of cracked gasoline is from thermal processes, such as coking or visbreaking.

A large proportion of the sulfur in gasoline is present in the catalytically cracked gasoline component. Such sulfur results from the sulfur content of the petroleum fractions being catalytically cracked. The sulfur impurities may require removal, usually by hydrotreating, in order to comply with product specifications or to ensure compliance with environmental regulations both of which are expected to become more stringent in the future, possibly permitting no more than about 30–50 pp sulfur in motor fuel gasolines, based on the weight of the gasoline. Low sulfur levels can contribute to reduced emissions of CO, NOx and hydrocarbons.

In FCC or TCC gasoline hydrotreating, the gasoline is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After completion of hydrotreating, the product may be fractionated, or flashed, to release the hydrogen sulfide and light hydrocarbons (e.g., those having a molecular weight below about C5, "$C_5^-$") and to collect the sweetened gasoline.

Cracked naphtha, as it comes from a catalytic or thermal conversion process and without any further treatments, such as purifying operations, has a relatively high octane number, due, in part, to the presence of olefinic components. As such, cracked gasoline is an excellent contributor to the gasoline pool, providing a large quantity of product at a high blending octane number. In some cases, this fraction may contribute as much as up to half the gasoline in the refinery pool. In special situations, where a refinery has no catalytic reformer, the cracked naphtha may represent as much as 80% of the refinery's gasoline.

Hydrotreating of any of the sulfur-containing fractions of cracked gasoline may lead to a reduction in the olefin content. However, octane number loss may be diminished by hydrotreating only the heaviest, most sulfur-rich and olefin-poor portion of the FCC gasoline. But if the future pool sulfur specification were reduced, an increasing amount of lighter boiling, olefin-rich, gasoline would be hydroprocessed, and the resulting octane number penalty would increase dramatically due to olefin saturation in these lighter gasoline fractions. The decrease in octane number which takes place as a consequence of sulfur removal by hydrotreating creates a tension between the need to produce gasoline fuels with sufficiently high octane number and the need to produce lower sulfur fuels.

Methods have been proposed for offsetting pool octane number reductions which might occur if severely hydrotreated, wide-cut FCC gasoline was introduced into the pool. Catalytic reforming increases the octane of virgin and hydrocracked naphthas by converting at least a portion of the paraffins and cycloparaffins to aromatics in these very low olefin content feeds. Reforming severity might be boosted to further increase the octane of the reformate going into the gasoline pool, thereby offsetting the negative impact on the pool from blending hydrotreated wide cut FCC gasoline. This approach, however, has two limitations. First, reformate yield declines as severity is increased which could negatively impact the total gasoline pool volume. Second, as already noted, aromatization reactions account, to a large degree, for the octane enhancement in reforming. However, specifications limit the amount of aromatics, particularly benzene, that may be present in the gasoline. It has therefore become desirable, as far as is feasible, to create a gasoline pool in which a greater portion of the octane number is contributed by non-aromatic components.

Instead of increasing reforming severity, post-reforming processes for increasing octane have been proposed such as those described in U.S. Pat. Nos. 3,767,568 and 3,729,409 in which the octane is increased by treatment of the reformate with ZSM-5. These processes, however, also can reduce reformats yield as severity is increased and thus impact overall gasoline pool volume. Instead of trying to use reforming or post-reforming approaches to compensate for pool octane losses potentially arising from the introduction of large amounts of hydrotreated FCC gasoline, it may be preferable to pursue strategies involving processing of the FCC gasoline itself. These can seek either to minimize octane loss during hydroprocessing or to achieve octane recovery in the hydroprocessed product.

Proposals have been made for removing sulfur impurities while retaining the high octane contributed by the olefins. For example, U.S. Pat. No. 3,957,625 discloses a method of removing sulfur from only the heavy fraction of a catalytically cracked gasoline by hydrodesulfurization, since the sulfur impurities tend to concentrate in the heavy fraction, while retaining the octane contribution from the olefins which are found mainly in the lighter fraction. Other methods have been proposed, which rely upon catalyst selection for selective hydrodesulfurization relative to olefin saturation, for example, by the use of a magnesium oxide support instead of the more conventional alumina. U.S. Pat. No. 4,049,542, for instance, discloses a process in which a copper catalyst is used to desulfurize an olefinic hydrocarbon feed such as catalytically cracked light naphtha.

Other processes for enhancing the octane rating of catalytically cracked gasolines have also been proposed in the past. For example, U.S. Pat. No. 3,759,821 discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 which discloses a process for desulfurizing naphtha by fractionating the naphtha into three fractions each of which is desulfurized by a different procedure, after which the fractions are recombined.

In cases where the gasoline pool sulfur specifications will not be met by processing only the heaviest, sulfur-rich olefin-poor portion of the FCC gasoline, the lighter components may also require treating to achieve acceptable sulfur levels. However, the octane number loss associated with hydroprocessing, or yield loss associated with processes aimed at recovering octane number losses, can increase dramatically with a widening of the boiling point range of the gasoline feed being treated.

Consequently, it would be desirable to develop cost-effective methods for preserving gasoline yield and octane number while removing sulfur from the relatively olefin-rich light and mid-range portions of the FCC gasoline pool.

SUMMARY OF THE INVENTION

Accordingly, an improved process has been developed for catalytically desulfurizing cracked fractions in the gasoline boiling range for reducing sulfur levels without substantially reducing the octane number. It has been discovered that a catalyst which includes at least one of a class of molecular sieve synthetic materials belonging to the MCM-22 family containing a metal component is beneficial in the gasoline upgrading process.

In one embodiment, a sulfur-containing cracked petroleum fraction in the gasoline boiling range is hydrotreated, in a first step, under conditions which remove at least a substantial proportion of the sulfur. The hydrotreated intermediate product is then treated, in a second step, by contact with a catalyst system of acidic functionality which comprises at least one of a class of molecular sieve materials belonging to the MCM-22 family and a metal component, preferably selected from the transition elements of the 4th or 5th period of the Periodic Table, under conditions which convert and substantially saturate the olefins contained in, and formed during processing of, the hydrotreated gasoline intermediate product fraction to provide a gasoline product fraction which has a higher octane value than the octane number of the gasoline fraction of the intermediate product.

Accordingly, an olefin-rich, sulfur-containing, cracked hydrocarbon stream as may be obtained, for example, from a catalytic or thermal cracking process, may be upgraded by contacting the stream with a catalytically effective amount of a hydrodesulfurization catalyst in a first reaction zone, operating under a combination of elevated temperature, elevated pressure and an atmosphere containing hydrogen, under catalytic conversion conditions, to produce an intermediate product containing a liquid fraction which has a reduced sulfur content and a reduced octane number as compared to the cracked hydrocarbon stream, and thereafter contacting at least the gasoline boiling range portion of the intermediate product in a second reaction zone with a catalytically effective amount of a second catalyst system having acidic functionality containing at least one molecular sieve belonging to the MCM-22 family and a metal component, preferably selected from the transition elements of the 4th or 5th period of the Periodic Table, under conditions which convert and substantially saturate the olefins contained in, and formed during processing of, the gasoline fraction of the intermediate product to provide a product with a gasoline fraction having a higher octane number than the octane number of the gasoline fraction of the intermediate product.

In one embodiment, the process may be utilized to desulfurize light and full range naphtha fractions while enhancing at least one of yield and octane number compared to processes employing other catalysts to restore octane number lost during hydrotreating.

DETAILED DESCRIPTION

Figure 1:
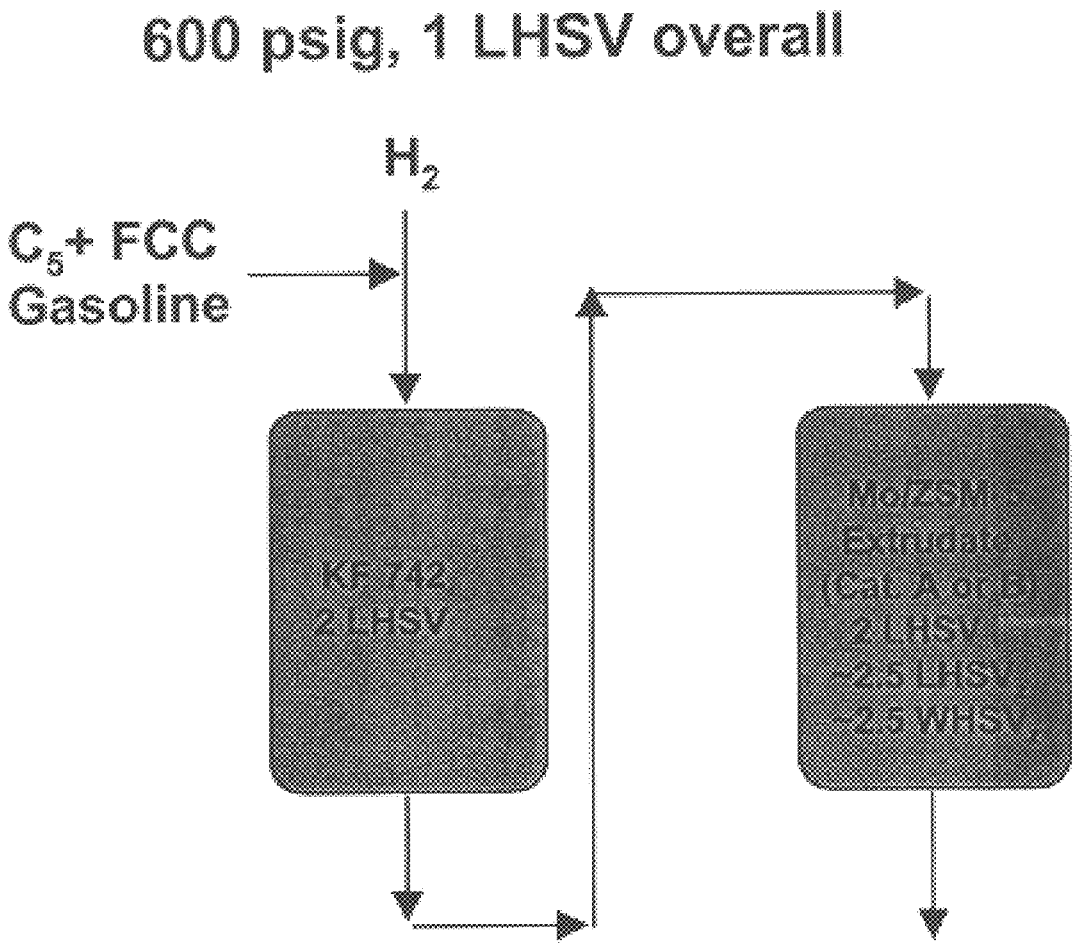
FIG. 1 schematically illustrates the process configuration employed in the studies of Examples 1 through 4. An alumina-bound Mo/ZSM-5 extrudate was employed in the second stage.

In an embodiment, the feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 420° F., or heavy gasoline fractions boiling at, or at least within, the range of about 330° F. to 500° F., preferably about 330° F. to 420° F. Preferred feeds are light or full range gasoline boiling range fractions.

The process may use as a feed all or a portion of the cracked gasoline fraction. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 150° F. (65° C.) to about 300° F. (150° C.) will be suitable. The exact cut point selected will depend on the sulfur specification for the gasoline product as well as on the type of sulfur compounds present. Sulfur which is present in components boiling below about 150° F. (65° C.) is mostly in the form of mercaptans, which may be removed by extractive type processes, such as MERICAT™, available from MERICHEM, Inc., Houston, Tex. Hydrotreating is appropriate for the removal of thiophene and other cyclic sulfur compounds present in higher boiling components, e.g. component fractions boiling above about 180° F. (82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically or thermally cracked fractions will depend on the sulfur content of the feed to the catalytic or thermal conversion unit as well as on the boiling range of the selected fraction used as the feed in the process. Lighter fractions, for example, will tend to have lower sulfur contents than the higher boiling fractions. As a practical matter, the sulfur content will exceed 50 ppm, based on the weight of the fraction, usually in excess of 100 ppm, and in most cases in excess of about 500 ppm. For the fractions which have 95 percent boiling points over about 380° F. (193° C.), the sulfur content may exceed about 1,000 ppm and may be as high as about 4,000 or about 5,000 ppm, or even higher. The nitrogen content is not as characteristic of the feed as the sulfur content and is preferably not greater than about 20 ppm, based on the weight of the feed, although higher nitrogen levels typically up to about 50 ppm may be found in certain higher boiling feeds with 95 percent boiling points in excess of about 380° F. (193° C.). The nitrogen level will, however, usually not be greater than about 250 to about 300 ppm. As a result of the cracking which has preceded the steps of the present process, the feed to the hydrodesulfurization step will be olefinic, with an olefin content of at least about 5 and more typically in the range of about 10 to about 30, e.g., about 15 to about 25, weight percent.

In an embodiment, the selected sulfur-containing, gasoline boiling range feed is treated in two steps. The first step involves hydrotreating the feed by effective contact of the feed with a catalytically effective amount of a hydrotreating catalyst, which may be a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product containing a normally liquid fraction boiling in substantially the same boiling range as the feed (gasoline boiling range), but which has a lower sulfur content and a lower octane number than the feed. Conventional hydrotreating conditions may be employed.

The hydrotreated intermediate product is then treated in a second step by contact with a catalytically effective amount of an acidic catalyst containing a metal component containing one or more transition metals under conditions which convert and substantially saturate the olefins produced during processing of the intermediate product in the second step, as well as any residual olefins from the hydrotreating step, to produce a second product having a fraction which boils in the gasoline boiling range which has a higher octane number than the portion of the hydrotreated intermediate product fed to this second step. The terminology "substantially saturate" refers to providing a product from the second step having a fraction which boils in the gasoling boiling range with an olefin level of less than about 3 wt. %, preferably less than about 2 wt. %, i.e., an olefin amount ranging from about 0 to about 2 wt. %, based on the weight of the second step's product. The product from this second step usually has a boiling range which does not differ substantially from the boiling range of the feed to the hydrotreater, but it is of lower sulfur content while having an enhanced octane rating compared to the hydrotreated intermediate product.

As discussed, one embodiment involves, as a first step, hydrotreating the feed to provide a hydrotreated product. While conventional conditions consistent with the goal of effective sulfur removal may be employed, the temperature of the hydrotreating step suitably ranges from about 400° F. to about 850° F. (about 20° C. to about 454° C.), preferably from about 500° F. to about 800° F. (about 260° C. to about 427° C.), with the exact selection dependent on the desulfurization desired for a given feed and catalyst. The hydrogenation reactions occurring in this step are exothermic, resulting in a rise in temperature along the reactor, which can provide at least some of the heat requirements for the second step which includes cracking, an endothermic reaction (i.e., a cascade mode). Thus, when operating in a cascade mode, the conditions in the first step should be adjusted not only to obtain the desired degree of desulfurization, but also to produce the required inlet temperature for the second step of the process so as to promote the desired reactions in that step. A temperature rise of about 20° F. to about 200° F. (about 11° C. to about 111° C.) is representative for the first step, and with the second step reactor inlet temperatures in the preferred 500° F. to 800° F. (260° C. to 427° C.) range, will normally provide a requisite initial temperature for cascading to the second step of the reaction. In embodiments where the first and second steps are operated separately with interstage separation and heating, control of the first step's exotherm is obviously not as critical; this two-step configuration may be preferred since it offers the capability of decoupling and optimizing the temperature requirements of the individual steps.

Conventional hydrodesulfurization conditions may be employed. As is known, hydrodesulfurization conditions may be regulated in connection with the amount and type of sulfur present in the feed. Accordingly, when the feeds are readily desulfurized, low to moderate pressures may be employed in the first step, typically ranging from about 50 to about 1500 psig (about 445 to about 10445 kPa), preferably about 100 to about 1000 psig (about 790 to about 7,000 kPa). Pressures refer to total system pressure at reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). LHSV is based on the volume of feed per volume of catalyst per hour. The hydrogen to hydrocarbon ratio in the feed is typically in the range of about 500 to about 5000 scf/bbl (about 90 to 900 $n.1.1^{-1}$), usually about 1000 to about 3000 scf/bbl (about 180 to about 535 $n.1.1^{-1}$). The extent of the desulfurization will depend on the feed sulfur content and, of course, on the product sulfur specification with the reaction parameters selected accordingly. It is not necessary to go to very low nitrogen levels, but low nitrogen levels will improve the activity of the catalyst in the second step of the process. Normally, the denitrogenation which accompanies the desulfurization will result in an acceptable organic nitrogen content in the feed to the second step of the process and, if necessary, the operating conditions in the first step may be adjusted to increase the denitrogenation.

The catalyst used in the hydrodesulfurization step may be a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used.

The particle size and the nature of the hydrotreating catalyst will usually be determined by the type of hydrotreating process which is being carried out, such as: a down-flow, liquid phase, fixed bed process; an up-flow, fixed bed, trickle phase process; an ebullating, fluidized bed process; or a transport, fluidized bed process. All of these different process schemes are conventional, and the choice of the particular mode may be made in accordance with conventional practice, although the fixed bed arrangements are preferred for simplicity of operation. Because of the feed boiling range and operating temperature and pressure, the process may operate in the vapor phase.

A change in the volume of gasoline boiling range material typically takes place in the first step. Although some decrease in volume occurs resulting from conversion to lower boiling products ($C_5$–), the conversion to $C_5$– products is typically not more than 5 volume percent and usually below 3 volume percent and is normally compensated for by the volume increase which takes place as a result of hydrogenation of components in the $C_5$+ liquid. At the conclusion of hydrotreating, all or a portion of the hydrotreated intermediate product may be conducted to the second step for further processing.

After the hydrotreating step, at least a portion of the hydrotreated intermediate product is passed to the second step of the process in which reactions take place in the presence of a bifunctional acid/metal catalyst. The effluent from the hydrotreating step may be subjected to an interstage separation in order to remove the inorganic sulfur and nitrogen, as hydrogen sulfide and ammonia, as well as light ends; but this is not necessary and, in fact, it has been found that the first step may be cascaded directly into the second step. This can be accomplished, for example, in a downflow, fixed-bed reactor by loading the hydrotreating catalyst directly on top of the second step catalyst.

In one embodiment, however, the separation of the light ends following step one may be desirable since the saturated $C_4$–$C_6$ fraction from the hydrotreater is a highly suitable feed to be sent to an isomerizer for conversion to isoparaffinic materials of high octane rating and since it will avoid the possible conversion of the light ends to nongasoline ($C_5$–) products in the second step of the process.

The conditions used in the second step are those which are appropriate to enhance yield, increase octane number, or both. Typically, the temperature of the second step will be about 300° F. to about 900° F. (about 150° C. to about 480° C.), preferably about 350° F. to about 800° F. (about 177° C. to about 427° C.). In a cascade configuration, the feed characteristics and the inlet temperature of the hydrotreating zone, coupled with the conditions used in the first step will set the first step exotherm and, therefore, the initial temperature of the second zone. Thus, the process can be operated in a completely integrated manner.

The second step's pressure will typically be comparable to that used in the first step, particularly if cascade operation is used. Thus, the pressure will typically range from about 50 to about 1500 psig (about 445 to about 10445 kPa), preferably about 100 to about 1000 psig (about 790 to about 7000 kPa) with space velocities from about 0.5 to about 10 LHSV ($hr^{-1}$) and normally about 1 to about 6 LHSV ($hr^{-1}$). Hydrogen to hydrocarbon ratios typically range from about 500 to about 5000 scf/bbl (about 90 to about 900 $n.1.1^{-1}$), preferably about 1000 to about 3000 scf/bbl (about 180 to about 535 $n.1.1^{-1}$).

The use of relatively lower hydrogen pressures can reduce product volume losses due to hydrocracking which may occur in the second step and for this reason, overall lower pressures are preferred if this can be accommodated by the constraints on achieving acceptable overall performance (desulfurization, octane recovery, and loss of catalyst activity, i.e., "aging") from the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$–) during the second step is held to a minimum. $C_5$– losses may be offset, at least partially, because the cracking of the heavier portions of the feed may lead to the production of products still within the gasoline range, particularly if the feed includes significant amounts of the higher boiling fractions. The volumetric yield from the overall process (i.e., hydrotreating+octane recovery) will be related to the specific feed being treated and the extent of sulfur reduction and octane recovery being sought.

The catalyst used in the second step of the process possesses sufficient acidic/metal functionality to bring about the desired reactions to restore the octane lost in the hydrotreating step. The preferred catalyst for this purpose contains zeolitic behaving catalytic materials which are exemplified by those acid acting materials having the topology of zeolitic materials exemplified by MCM-22.

The "alpha test" may be used to identify catalysts useful in the second step. As used herein, the alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980). The catalyst used in the second step of the process suitably has an alpha activity of at least about 20, usually in the range of 20 to 800 and preferably at least about 50 to 450.

The acidic catalyst is a dual function catalyst system comprised of one or more molecular sieves of the MCM-22 family. For purposes of this invention, these materials of the MCM-22 family include MCM-22, MCM-36, MCM-49 and MCM-56. While several synthesis procedures exist, these materials can be synthesized preferably with hexamethylene imine as the organic directing agent; the specific product depends upon the particular synthesis and post synthesis treatments employed. The resultant product can be characterized by X-ray diffraction. For example, MCM-22, is characterized by an X-ray diffraction pattern including interplanar d-spacings at 12.36+/–0.4, 11.03+/–0.2, 8.83+/–0.14, 6.18+/–0.12, 6.00+/–0.10, 4.06+/–0.07, 3.91+/–0.07 and 3.42+/–0.06 Angstroms. The catalyst also comprises a metal component which preferably contains one or more transition metals. The term "transition metal" as used herein refers to elements of Periods 4–6, Groups 3–12 (IUPAC classification, previously Groups Ib–VII b and VIII) of the Periodic Table, including the noble metals within those groups. The metal component can include platinum, palladium or a combination of platinum and palladium. Preferably, the transition metals are selected from the transition elements of the $4^{th}$ or $5^{th}$ period and more preferably from the transition elements of the $4^{th}$ or $5^{th}$ period, Groups 3–7 and 11–12 of the Periodic Table. Most preferably, the transition metal is molybdenum. For purposes of this invention, when the second step catalyst is referred to as a zeolite it includes molecular sieves of the MCM-22 family.

The molecular sieve exemplified by MCM-22 is described in U.S. Pat. Nos. 4,962,256, 4,992,606 and 4,954,325 to which reference is made for a description of this zeolite, its properties and its preparation, the entire disclosures of which are incorporated herein by reference. In its calcined form, the molecular sieve component of the catalyst is characterized by an X-ray diffraction pattern, described in the above cited patents, as well as in U.S. Pat. No. 5,413,697, the disclosure of which is incorporated herein by reference. Other porous crystalline or layered materials of the MCM-22 family, such as MCM-36, MCM-49 and MCM-56 are described in U.S. Pat. Nos. 5,250,277, 5,236,575 and 5,362,697, respectively, each of which are incorporated herein by reference.

Examples of other porous crystalline materials conforming to the requisite structural types and having very similar characteristic X-ray diffraction patterns to that of MCM-22 include the PSH-3 composition of U.S. Pat. No. 4,439,409 and the zeolite SSZ-25 composition of U.S. Pat. No. 4,826,667, to which reference is made for a description of those materials as well as of their preparation.

The preferred molecular sieve material is MCM-22. MCM-22 has a chemical composition expressed by the molar relationship:

$$X_2O_3:(n)YO_2,$$

where X is a trivalent element, such as aluminum, boron, iron and/or gallium, preferably aluminum, Y is a tetravalent element such as silicon and/or germanium, preferably silicon, and n is at least about 10, usually from about 10 to about 150, more usually from about 10 to about 60, and even more usually from about 20 to about 40. In the as-synthesized form, MCM-22 has a formula, on an anhydrous basis and in terms of moles of oxides per n moles of $YO_2$, as follows:

$$(0.005–0.1)Na_2O:(1–4)R:X_2O_3:nYO_2$$

where R is an organic component. The Na and R components are associated with the molecular sieve as a result of their presence during crystallization, and are easily removed by the post-crystallization methods described in U.S. Pat. No. 4,954,325.

MCM-22 is thermally stable and exhibits a high surface area, often greater than about 400 $m^2$/gm as measured by the BET (Brunauer, Emmett and Teller) test and unusually large hydrocarbon sorption capacity when compared to previously described crystal structures having similar X-ray diffraction patterns. As is evident from the above formula, MCM-22 is synthesized nearly free of Na cations and thus possesses acid catalysis activity as synthesized. It can, therefore, be used as a component of the catalyst without having to first undergo an exchange step. To the extent desired, however, the original sodium cations of the as-synthesized material can be replaced by established techniques including ion exchange with other cations. Preferred replacement cations include metal ions, hydrogen ions, hydrogen precursor ions, e.g., ammonium and mixtures of such ions.

In its calcined form, MCM-22 appears to be made up of a single crystal phase with little or no detectable impurity crystal phases and has an X-ray diffraction pattern as discussed above. Prior to its use as the catalyst in the present process, the crystals should be subjected to thermal treatment to remove part or all of any organic constituent present in the as-synthesized material.

The molecular sieve, in its as-synthesized form which contains organic cations as well as when it is in its ammonium form, can be converted to another form by thermal treatment. This thermal treatment is generally performed by heating one of these forms at a temperature of at least about 370° C. for at least 1 minute and generally not longer than 20 hours. While subatmospheric pressure can be employed for the thermal treatment, atmospheric pressure is preferred simply for reasons of convenience. The thermal treatment can be performed at a temperature of up to a limit imposed by the irreversible thermal degradation of the crystalline structure of the molecular sieve.

Prior to its use in the process, the molecular sieve crystals should be dehydrated, at least partially. This can be done by heating the crystals to a temperature in the range of from about 200° C. to about 595° C. in an atmosphere such as air, nitrogen, etc. and at atmospheric, subatmospheric or superatmospheric pressures for between about 30 minutes to about 48 hours. Dehydration can also be performed at room temperature merely by placing the crystalline material in a vacuum, but a longer time is required to obtain a sufficient amount of dehydration.

It is also possible to treat the molecular sieve with steam at elevated temperatures ranging from about 800° F. to about 1600° F. (about 427° C. to about 871° C.) and treatment may be accomplished in atmospheres consisting partially or entirely of steam.

The catalyst may employ the use of a binder or substrate into which the molecular sieves are incorporated because the small particle sizes of the pure sieve material can lead to an excessive pressure drop in a catalyst bed. This binder or substrate, which can be used, is suitably any refractory binder material. Examples of these materials are well known and typically include silica, silica-alumina, silica-zirconia, silica-titania, alumina and mixtures thereof. Alternatively, the zeolite can be used in a self-bound form, e.g. as a cylindrical extrudate of essentially 100% molecular sieve.

The molecular sieve materials are exemplary of the topology and pore structure of suitable acid-acting refractory solids. A useful catalyst system is not confined, however, to the aluminosilicate versions and other refractory solid materials which are characterized by the above-described acid activity, pore structure and topology may be used. The designations referred to above, for example define the topology only and do not restrict the compositions of the molecular sieve catalyst components.

A suitable metal component may be deposited on the molecular sieve, 100% molecular sieve extrudate or sieve/binder combination by conventional impregnation or exchange techniques, either before, after or during the addition of the binder. For example, an unsteamed extrudate of Mo/100% MCM-22 containing about 0.5 to about 5 wt. % molybdenum, based on the weight of the catalyst, represents one effective version of the catalyst.

The octane efficiency of the process, i.e., the octane gain relative to the yield loss, will vary according to a number of factors, including the nature of the feedstock, the conversion level and the activity of the catalyst.

The feed and first and second step process conditions may be selected to provide a product in which the gasoline product octane is equal to, or not substantially lower than, the octane of the feed's gasoline boiling range material (preferably not lower by more than about 1 to 3 octane numbers). It is preferred also that the volumetric yield of the product is minimally diminished relative to the feed. In some cases, the gasoline boiling range product's volumetric yield, octane number, or both, may be higher than the feed's and, in favorable cases, the octane barrels (i.e., the octane number times the volume) of the product will be higher than the octane barrels of the feed.

The operating conditions in the first and second steps may be the same or different but the exotherm from the hydrotreatment step will normally result in a higher initial temperature for the second step. Where there are distinct first step and second step conversion zones, whether in cascade operation or otherwise, it is often desirable to operate the two zones under different conditions. Thus the second zone may be operated at higher temperature and lower pressure than the first zone in order to maximize the octane increase. RON signifies the research octane number, which correlates to the combustion characteristics of an automobile engine operated at low speed and low inlet temperature; MON signifies the motor octane number, which correlates to an automobile engine operating at a higher speed and higher inlet temperature; and the average of the two, (RON+MON)/2, is known as the road octane number, which gives an indication of typical performance in an engine.

Further increases in the volumetric yield of the gasoline boiling range fraction of the product, and possibly also of the octane number (particularly the motor octane number), may be obtained by using a portion of the $C_3$–$C_4$ product as feed for an alkylation process to produce alkylate of high octane number.

The process should normally be operated under a combination of conditions such that the desulfurization should be at least about 50%, preferably at least about 75%, as compared to the sulfur content of the feed. It is reasonable to expect that, with a heavy cracked naphtha feed, the first step hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could be as much as about 15%.

The second step of the process should be operated under a combination of conditions such that at least about 50% of the octane lost in the first step operation would be recovered, and preferably such that substantially all of the lost octane would be recovered.

EXAMPLES

The following examples have been carried out to illustrate embodiments of the best mode of the invention at the present time. The scope of the invention is not in any way limited by the examples set forth below. These examples include the preparation of two different samples of catalysts in accordance with the invention, evaluation of these catalysts in the upgrading step of the present invention, and comparative evaluation of catalysts containing zeolite ZSM-5.

Example 1

An 80 wt. % Mo-ZSM-5/20 wt. % alumina extrudate catalyst, containing 3.9 wt. % Mo and having an alpha value of about 100, Catalyst A, was evaluated for treating a full-range sulfur containing FCC gasoline feed ("$C_5$+ feed"). Feed properties are listed in TABLE 1 below.

TABLE 1

| | |
|---|---|
| S, ppm | 2065 |
| Specific Gravity | 0.7551 |
| Paraffins, wt. % | 5.4 |
| I-paraffins, wt. % | 22.5 |
| Olefms, wt. % | 30.2 |
| Naphthenes, wt. % | 8.5 |
| Aromatics, wt. % | 33.4 |
| Calculated RON | 93.6 |
| Calculated MON | 81.3 |
| Calculated (R + M)/2 | 87.4 |
| RON (micro octane measurement) | 93.0 |
| MON (micro octane measurement) | 81.2 |
| (R + M)/2 from micro octane results | 87.1 |
| $T_{50}$, ° F. | 234 |
| $T_{90}$, ° F. | 391 |

Equal volumes of a commercial CoMo/alumina hydrotreating catalyst (KF-742) and Catalyst A were loaded into the upstream and downstream reactors, respectively, of a two-stage cascade reactor testing unit (Cascade Reactor A), as shown schematically in FIG. 1.

After reactor loading, the catalysts in both reactors were dried in nitrogen at about 300° F. for at least 12–16 hours. They were then sulfided at atmospheric pressure by exposing the catalysts to $H_2$ containing 2% $H_2S$, while ramping the temperature to 450° F. followed by a 1 hour hold, and then ramping the temperature to about 700° F. followed by a 12 hour hold. Thereafter, the reactors were purged with $H_2$ and cooled to 150° F. The pressure was then adjusted to 600 psig and the $C_5$+ feed was introduced at a LHSV of 4 $hr^{-1}$, relative to the first reactor, and maintained at this level while the temperature of the first reactor was adjusted to 700° F. over a period of 3–4 hours. Thereafter, the feed rate was reduced to a LHSV of 2 $hr^{-1}$. The reactors were lined-out for about 8 hours after the temperature of the first reactor reached 700° F. Material balances were initiated at the conclusion of the lineout period.

Figure 2:
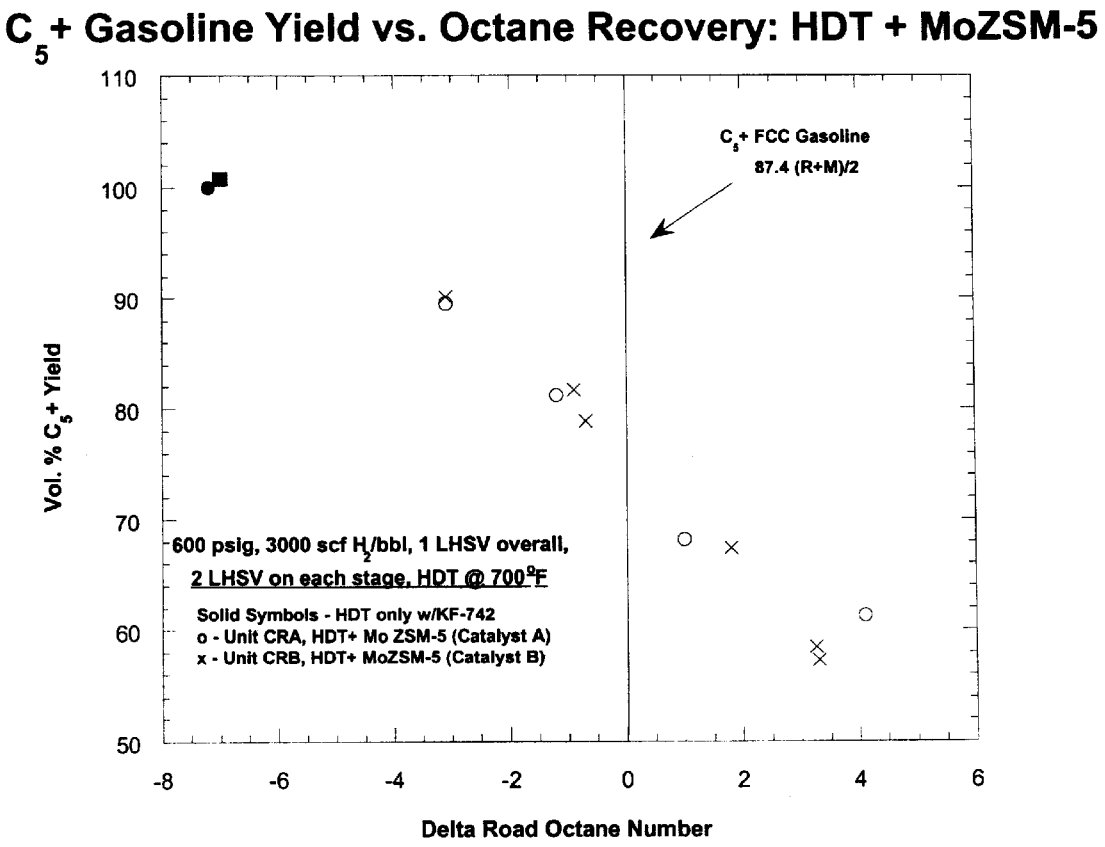
FIG. 2 shows the variation of the volume % $C_5$+ yield with the changes in road octane number for the studies of Examples 1 through 4.

To avoid any influence from Catalyst A, the second reactor was maintained at about 300° F. Processing over the KF-742 catalyst at 700° F., 3000 scf $H_2$/bbl, and an LHSV of 2 $hr^{-1}$ in the first stage resulted in essentially complete olefin saturation and greater than 97% desulfurization. Volumetric yield of the desulfurized $C_5$+ product was about 101% as a result of volume swell arising from hydrogen addition to the feed. Due primarily to the loss of olefins accompanying desulfurization, the road octane number, (R+M)/2, was reduced by 7–8 numbers. The results are plotted in FIG. 2.

Example 2

After the conclusion of testing the performance of the first stage hydrotreating catalyst alone as described in Example 1, the hydrotreating reactor continued to operate at 700° F. as the temperature on Catalyst A in the second stage catalyst was varied. Material balances were performed at second stage temperatures ranging from 700 to 775° F. The temperature in the second stage was varied in order to determine the $C_5$+ yield penalty resulting from reactions over Catalyst A in recovering the octane lost in the upstream hydrotreating step. In this mode, hydrogen circulation to the cascade unit was maintained at 3000 scf $H_2$/bbl and the LHSV on each stage was maintained at 2 (overall LHSV of 1, based upon total catalyst in both stages). The results are plotted in FIG. 2. A review of the graph in FIG. 1 reveals that the volumetric yield of desulfurized $C_5$+ product at complete recovery of the road octane number, (R+M)/2, was about 76%.

Example 3

A second 80 wt. % Mo-ZSM-5/20 wt. % alumina extrudate catalyst, containing 3.7 wt. % Mo and having an alpha value of about 100, Catalyst B, was evaluated under conditions similar to Example 1, but using a different two-stage cascade reactor (Cascade Reactor B). Equal volumes of the commercial CoMo/alumina hydrotreating catalyst (KF-742) and Catalyst B were loaded into the upstream and downstream reactors, respectively, of Cascade Reactor B. Again, as in Example 1, the reactor configuration is shown schematically in FIG. 1.

Catalyst B in the second reactor was maintained at about 300° F., as in Example 1, to establish a base line for the hydrotreating catalyst. Processing over the KF-742 catalyst at 700° F., 3000 scf $H_2$/bbl, and a LHSV of 2 $hr^{-1}$ in the first stage resulted in essentially complete olefin saturation and greater than 97% desulfurization. Volumetric yield of desulfurized $C_5$+ product was about 101% as a result of volume swell arising from hydrogen addition to the feed. Due primarily to the loss of olefins accompanying desulfurization, the road octane number, (R+M)/2, was reduced by 7–8 numbers. The results are plotted on the graph in FIG. 2. These results are essentially identical to those of Example 1 and thus confirm performance and demonstrate no dependency of the hydrotreating catalyst results on the testing unit employed.

Example 4

This example was conducted in a similar manner to Example 2, but employing Catalyst B in Cascade Reactor B. The example proceeds from Example 3, just as Example 2 does from Example 1.

After the conclusion of testing the performance of the first-stage hydrotreating catalyst alone as described in Example 3, the hydrotreating reactor continued to operate at 700° F. as the temperature on Catalyst B in the second stage was varied. Material balances were performed at second stage temperatures ranging from 700 to 775° F. The temperature was varied in order to determine the $C_5$+ yield penalty resulting from reaction over Catalyst B in recovering the octane lost in the upstream hydrotreating step. In this mode, hydrogen circulation to the cascade unit was maintained at 3000 scf $H_2$/bbl and the LHSV on each stage was 2 (overall LHSV=1). The results are plotted in FIG. 2. A review of the graph in FIG. 2 reveals that the volumetric yield of desulfurized $C_5$+ product at complete recovery of the road octane number, (R+M)/2, was about 76%. These findings are essentially identical to those of Example 2 and thus confirm performance and demonstrate no dependency of the results on either the version of the Mo containing ZSM-5 catalyst used or the testing unit employed.

Example 5

A molybdenum-containing MCM-22 catalyst, Catalyst C, was prepared using 100% MCM-22 1/20" quadrilobe extrudates, having an alpha value of about 370. The MCM-22 extrudates were impregnated with about 2.4 wt. % molybdenum using a 0.025M aqueous solution of ammonium heptamolybdate tetrahydrate at room temperature. The extrudates were dried at 300° F. (150° C.) and calcined in air at 1000° F. (538° C.) for 3 hours.

Figure 3:
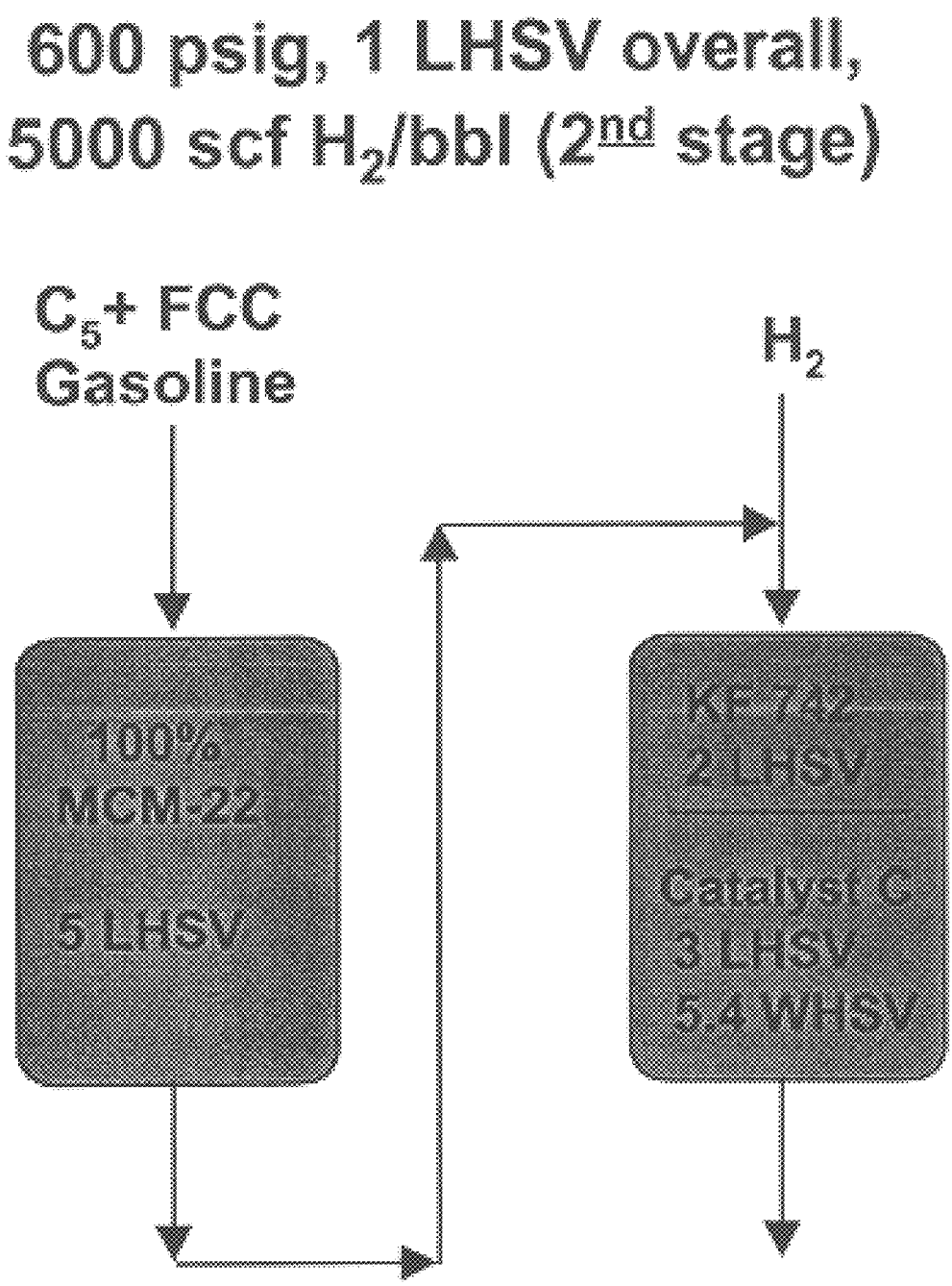
FIG. 3 schematically illustrates the process configuration employed in Example 5.

3.0 cc of the base 100% MCM-22 extrudate (i.e., no molybdenum) were loaded into an upstream reactor for use as a pretreater reactor. The downstream stage of Cascade Reactor A was loaded with 7.5 cc's of the KF-742 catalyst followed by 5 cc's of the finished Mo-containing catalyst, Catalyst C. The reactor configuration is shown schematically in FIG. 3.

The $C_5$+ FCC feed was introduced to the reactor system and maintained at a LHSV of 5 $hr^{-1}$ corresponding to the "pretreater" reactor, 2 $hr^{-1}$ relative to the KF-742 catalyst in the downstream stage of the Cascade Reactor and 3 $hr^{-1}$ relative to Catalyst C in the down stream stage of the Cascade Reactor. The catalyst loadings used in the downstream stage of the cascade reactor and the $C_5$+ feed rate were chosen to provide a comparable hydrotreating catalyst LHSV and a similar zeolite-based LHSV to those existing in Examples 2 and 4 above. The reactor was configured such that the pretreater reactor operated with no $H_2$ circulation, while 5000 scf $H_2$/bbl was delivered to the downstream reactor stage. The pretreater reactor temperature was held constant at each of several temperatures (150° F., 400° F., and 700° F.), while the second-stage reactor temperature was varied over a temperature range of 700° F. to 750° F. at each of the constant first stage temperatures. As before, the temperature in the second stage was varied in order to determine the $C_5$+ yield penalty resulting from reactions over Catalyst C in recovering the octane lost over the hydrotreating catalyst which preceded it. The results are plotted in FIG. 4.

Figure 4:
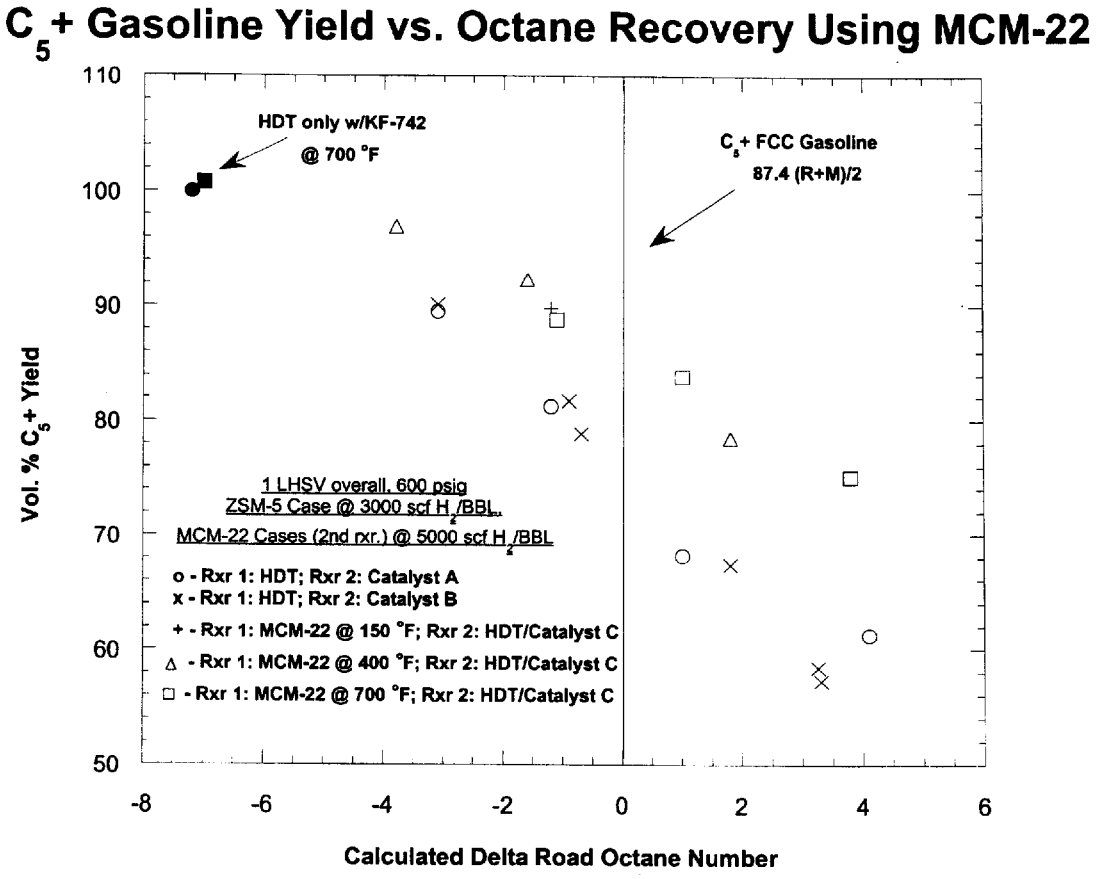
FIG. 4 shows the variation of the volume % $C_5$+ yield with changes in the road octane number for the study of Example 5.

A review of the graph in FIG. 4 reveals two points: 1) the volumetric yield of desulfurized $C_5$+ product at complete recovery of the road octane number, (R+M)/2, was about 10% higher than that obtained over either Catalyst A or B (~86% vs. ~76%); and 2) the pretreater reactor temperature had little impact on the yield/octane behavior of the product from the second stage reactor indicating that the "pretreater" was unimportant.

Example 6

A second Mo/MCM-22 catalyst, Catalyst D, was prepared using 100% MCM-22 1/20" quadrilobe extrudates, having an alpha value of about 430. The extrudates were impregnated with 2.3 wt. % molybdenum in a similar manner to Catalyst C.

Figure 5:
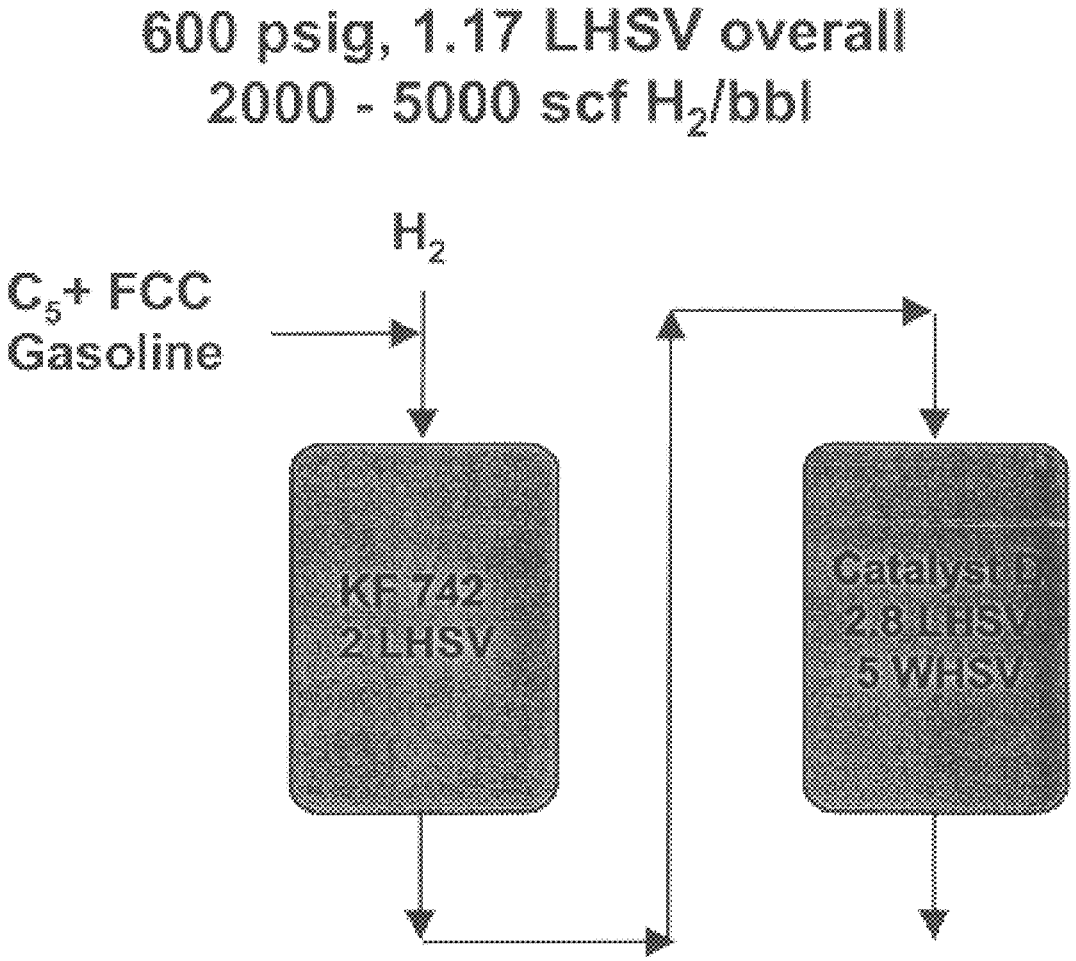
FIG. 5 schematically illustrates the process configuration employed in Examples 6 and 7.

The finished catalyst, Catalyst D, was utilized in Cascade Reactor B as follows: 7.0 cc of the KF-742 catalyst was loaded into the upstream stage of the reactor and 5 cc's of Catalyst D was loaded into the downstream stage of the reactor. The reactor configuration is shown schematically in FIG. 5.

The $C_5$+ feed rate corresponded to an LHSV of 2 $hr^{-1}$ on the KF-742 in the first stage reactor, and a LHSV of 2.8 $hr^{-1}$ (WHSV of 5 $hr^{-1}$) on Catalyst D. The catalyst loadings and the feed rate were chosen to provide a hydrotreating catalyst LHSV and a zeolite-based LHSV similar to that in Examples 2, 4 and 5. In addition, the zeolite-based WHSV is similar to that of Example 5. The overall LHSV is also similar to that of Examples 2, 4, and 5.

Figure 6:
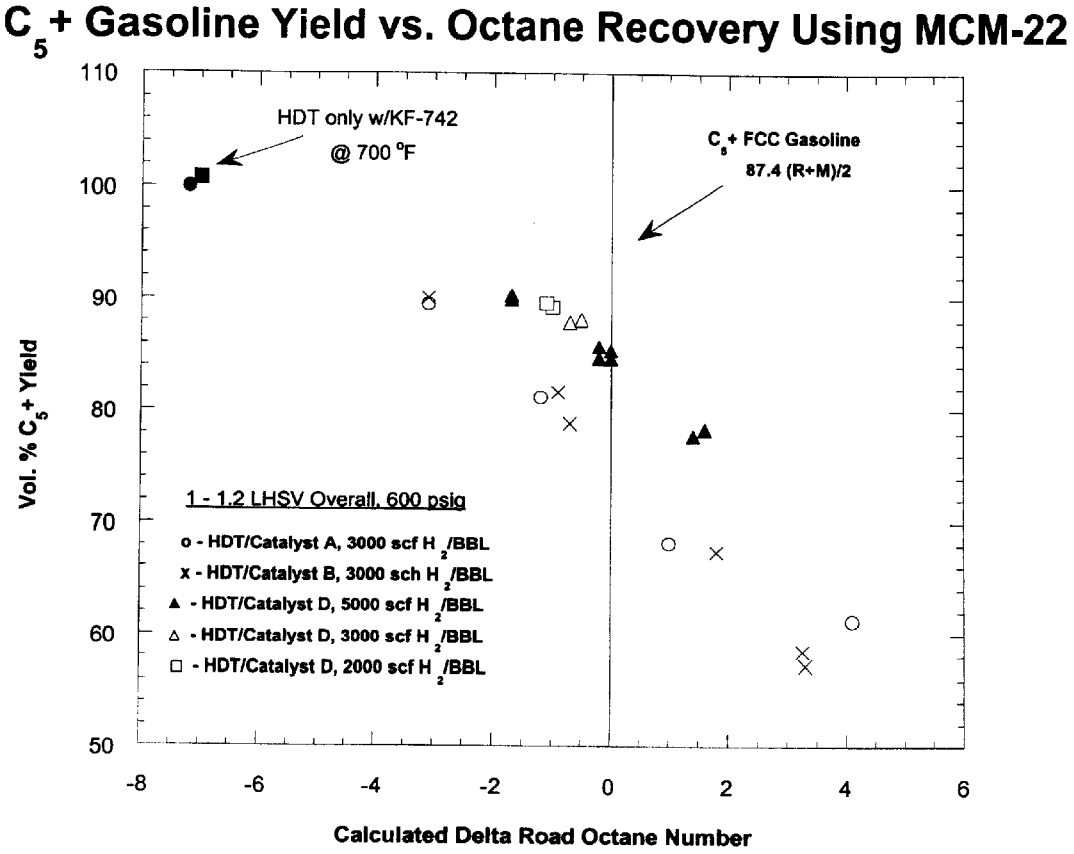
FIG. 6 shows the variation of the volume % $C_5$+ yield with changes in the road octane number for the studies of Examples 6 and 7.

As in examples 2 and 4, the first stage hydrotreating catalyst operated at 700° F. while the temperature on second stage was varied in order to determine the $C_5$+ yield penalty resulting from reactions over Catalyst D in recovering the octane lost in the upstream hydrotreating step. Material balances were performed at second stage temperatures ranging from 700 to 735° F. Hydrogen circulation to the cascade unit was maintained at 5000 scf $H_2$/bbl as in Example 5. The results are plotted in FIG. 6. A review of the graph in FIG. 6 reveals that the volumetric yield of desulfurized $C_5$+ product at complete recovery of the road octane number, (R+M)/2, was about 8% higher than that obtained over either Catalyst A or B, with yield benefits similar to those for Catalyst C.

The similarity of these findings to those of Example 5 also indicate no dependency of the results on the testing unit employed or on the particular preparation of Mo-MCM-22.

Example 7

After performing the material balances as described in Example 6, the reaction was continued with the first-stage hydrotreating catalyst operating at 700° F. and the second-stage operating at 715° F. Hydrogen circulation to the cascade unit was reduced from 5000 scf $H_2$/bbl to 3000 scf $H_2$/bbl, i.e., the same level employed in Examples 2 and 4 using Catalysts A and B, respectively. Thereafter, it was further reduced to 2000 scf $H_2$/bbl. The results are plotted on the graph in FIG. 6. A review of the graph in FIG. 6 reveals that the data still generally conformed to the same superior yield/octane performance curve resulting from the use of Catalysts C and D, relative to the curve resulting from the use of Catalyst A and B. The 715° F. data at 3000 and 2000 scf $H_2$/bbl fall between the 700° F. and 715° F. data obtained at 5000 scf $H_2$/bbl. This indicates that equivalent performance at reduced hydrogen circulation can be achieved by modest increases (~5–10° F.) in operating temperature.

Example 8

From PIONA analysis of products from Examples 4 and 6, Table 2 below shows the composition of the $C_5$+ products from Catalyst B and Catalyst D at complete recovery of road octane. The data for Catalyst B represents interpolated values, since experimental yield/octane results straddled the point corresponding to complete octane recovery.

TABLE 2

| Component, wt. % | Catalyst B | Catalyst D |
|---|---|---|
| Paraffins | 7.2 | 8.8 |
| I-paraffins | 27.7 | 34.5 |
| Olefins | 0.0 | 0.0 |
| Naphthenes | 8.6 | 10.0 |
| Aromatics | 32.5 | 30.6 |
| Total $C_5$ + Yield, wt feed | 76.0 | 83.9 |
| $C_5$ + specific gravity | 0.7565 | 0.7418 |

A review of Table 2 reveals that the yield benefit with Catalyst D is derived largely from higher levels of I-paraffin in the product. While not being bound by theory, it is believed that the I-paraffin levels are sufficient to offset any octane debits potentially associated with slightly lower aromatics levels and slightly higher naphthene and n-paraffin levels, such that equivalent octane is maintained at increased yield. Furthermore, the compositional difference in the $C_5$+ product from Catalyst D provide a higher gravity (lower density) product, further enhancing yields on a volumetric basis.

What is claimed is:

1. A process for upgrading a hydrocarbon stream from a catalytic or thermal cracking process comprising:

contacting an olefin-rich, sulfur-containing cracked hydrocarbon product stream with a catalytically effective amount of a hydrodesulfurization catalyst in a first reaction zone under catalytic hydrodesulfurization conditions in the presence of hydrogen, to produce an intermediate product comprising a liquid fraction which has a reduced sulfur content and a reduced octane number as compared to said cracked hydrocarbon product stream; and contacting at least a gasoline boiling range portion of said intermediate product in a second reaction zone with a catalytically effective amount of an acidic catalyst comprising at least one molecular sieve belonging to the MCM-22 family in combination with a metal component under catalytic conversion conditions which convert and substantially saturate the olefins contained in, and formed during processing of, the gasoline boiling range portion of the intermediate product to provide a product comprising a fraction boiling in the gasoline boiling range having an octane number that is substantially the same as or higher than the octane number of the gasoline boiling range fraction of the intermediate product.

2. The process of claim 1 in which the cracked hydrocarbon product stream comprises at least one of a full range thermally or catalytically cracked naphtha fraction having a boiling range within the range of about $C_5$ to about 420° F. and a light catalytically cracked naphtha fraction having a boiling range within the range of about $C_5$ to about 330° F.

3. The process of claim 1 in which the total sulfur content of the product fraction boiling in the gasoline boiling range is not more than 100 ppm, based on the weight of the fraction.

4. The process of claim 1 in which said metal component comprises one or more transition metals selected from the transition elements of the 4th or 5th period of the Periodic Table.

5. The process of claim 1 in which said metal component comprises one or more transition metals selected from the transition elements of the $4^{th}$ or $5^{th}$ period, Groups 3–7 and 11–12 of the Periodic Table.

6. The process of claim 1 in which said metal component comprises platinum, palladium or a combination of platinum and palladium.

7. The process of claim 1 in which said molecular sieve is MCM-22 and said metal component is molybdenum.

8. The process of claim 7 in which the molybdenum is present in an amount from about 2 to 5 weight percent of the catalyst.

9. The process of claim 1 in which the hydrodesulfurization conditions include a temperature of about 400° F. to about 800° F., a pressure of about 50 to about 1500 psig, a space velocity of about 0.5 to about 10 LHSV, and a hydrogen to hydrocarbon ratio of about 500 to about 5000 standard cubic feet of hydrogen per barrel of feed.

10. The process of claim 1 in which the catalytic conversion conditions include a temperature of about 300° F. to about 900° F., a pressure of about 50 to about 1500 psig, a space velocity of about 0.5 to about 10 LHSV, and a hydrogen to hydrocarbon ratio of about 0 to about 5000 standard cubic feet of hydrogen per barrel of feed.

11. The process of claim 1 in which the product fraction boiling in the gasoline boiling range has a higher octane number than that of the gasoline boiling range fraction of the intermediate product and a lower total sulfur content than that of the sulfur-containing cracked hydrocarbon product stream.

12. The process of claim 1 wherein the yield of the product fraction boiling in the gasoline boiling range, having a higher road octane number than the cracked hydrocarbon product stream, is greater than 80 volume percent.

* * * * *